US009797239B2

(12) United States Patent
Godfrey

(10) Patent No.: US 9,797,239 B2
(45) Date of Patent: Oct. 24, 2017

(54) MONITORING FLOW CONDITIONS DOWNWELL

(71) Applicant: OPTASENSE HOLDINGS LIMITED, Farnborough, Hampshire (GB)

(72) Inventor: Alastair Godfrey, Farnborough (GB)

(73) Assignee: Optasense Holdings Limited (GB)

( * ) Notice: Subject to any disclaimer, the term of this patent is extended or adjusted under 35 U.S.C. 154(b) by 202 days.

(21) Appl. No.: 14/380,124

(22) PCT Filed: Feb. 25, 2013

(86) PCT No.: PCT/GB2013/050455

§ 371 (c)(1),
(2) Date: Aug. 21, 2014

(87) PCT Pub. No.: WO2013/132227

PCT Pub. Date: Sep. 12, 2013

(65) Prior Publication Data

US 2015/0013446 A1 Jan. 15, 2015

(30) Foreign Application Priority Data

Mar. 5, 2012 (GB) ..... 1203854.3

(51) Int. Cl.
*E21B 47/10* (2012.01)
*E21B 47/12* (2012.01)
*E21B 47/06* (2012.01)

(52) U.S. Cl.
CPC ..... *E21B 47/10* (2013.01); *E21B 47/123* (2013.01); *E21B 47/06* (2013.01)

(58) Field of Classification Search
CPC ..... E21B 47/01; E21B 47/10; E21B 47/101; E21B 49/003; E21B 49/006
(Continued)

(56) References Cited

U.S. PATENT DOCUMENTS 5,995,449 A * 11/1999 Green ..... E21B 23/04 340/853.3
6,041,872 A * 3/2000 Holcomb ..... E21B 47/123 175/40
(Continued)

FOREIGN PATENT DOCUMENTS

EP 2418466 2/2012
GB 2398869 9/2004
(Continued)

*Primary Examiner* — Bejamin Schmitt
(74) *Attorney, Agent, or Firm* — McDonnell Boehnen Hulbert & Berghoff LLP

(57) ABSTRACT

This application describes methods and apparatus for monitoring flow at a given location downwell. The method of comprises performing fiber optic sensing on an optical fiber 204 deployed within the well 101. The optical fiber is attached to first tubing (201) that extends into the well to at least a first location (110*a-c*) at which it is wished to monitor inflow. The first tubing comprises at least one aperture (202*a-c*) having known properties at said first location. The first tubing is in fluid communication with flow tubing (107) that provides flow to/from the top (108) of the well. In use fluid therefore flows into the first tubing via the apertures (202*a-c*) which, having known properties, provide a calibrated response that can be detected by a fiber optic sensor unit (205).

19 Claims, 3 Drawing Sheets

(58) Field of Classification Search
USPC ..... 73/152.32, 152.47
See application file for complete search history.

(56) References Cited

U.S. PATENT DOCUMENTS

| | | | | |
|---|---|---|---|---|
| 2002/0125008 | A1* | 9/2002 | Wetzel ..... | A45C 13/02<br>166/278 |
| 2011/0088462 | A1 | 4/2011 | Samson et al. | |
| 2012/0016587 | A1 | 1/2012 | Sierra et al. | |

FOREIGN PATENT DOCUMENTS

| | | |
|---|---|---|
| GB | 2442745 | 4/2008 |
| WO | WO 98/50680 | 11/1998 |
| WO | WO 2010/136773 | 12/2010 |

* cited by examiner

MONITORING FLOW CONDITIONS DOWNWELL

FIELD OF THE INVENTION

This application relates to monitoring of flow conditions in wells, for example oil or gas production wells, using fibre optic distributed sensing, in particular fibre optic distributed acoustic sensing.

BACKGROUND OF THE INVENTION

In some situations there is a desire to monitor flow of fluid downwell, for instance the inflow in an oil or gas production well at a given depth/distance into a well. The rate of flow of product at the top of the well can be relatively easily be determined, for example by using a suitable flow meter. However the inflow at different depths/distances into the well may be of interest. For example it may be wished to determine the relative contribution to the total flow of the various different sections of the well which provide an inlet for the oil or gas.

This may be useful for long term monitoring and/or to provide useful information for planning future wells. Typically the formation of a production well involves drilling into a rock structure which holds a reservoir of hydrocarbons and performing a perforation step, where shaped charges are fired to perforate the rock and provide a flow path for the oil/gas. Typically there may be many perforation sites at different distances into the well. Monitoring the flow, in subsequent operation, from each perforation site may provide useful information for planning the perforation sites in other wells. Also, in formation of some wells there may also be a fracturing step following perforation, e.g. hydraulic fracturing where a fluid is forced into the well under pressure, to fracture the rock to release the oil/gas from the rock and provide a flow path. Monitoring the flow for the various in-flow sites may provide information about how successful the fracturing step has been and whether the flow is coming from all sites evenly or whether there are significant differences in flow at different parts of the reservoir. Monitoring the flow may also provide indications about changes in the flow from different parts of the reservoir over time.

Also in some instances a well may be divided into a number of different production zones which are effectively owned or leased by different organisations. Thus there may be a need to determine the relative contribution to the total flow from each production zone.

It may also be desired to monitor out-flow in injection wells, for example to monitor that the injected fluid is being injected into the reservoir evenly.

The use of permanent flow meters at different depths within a well is not generally practical due to the difficulties in providing suitably rugged equipment that can survive the harsh conditions in a production well for long periods of time, and the difficulties in installing such equipment with a suitable power supply and means of relaying the flow data to the surface. Typically therefore flow readings are acquired periodically by inserting wire line tools having one or more flow meters into the well on a temporary basis and taking flow readings at different depths. However the use of wire line tools involves halting normal well operation and is a relatively expensive procedure.

Various fibre optic sensors have been proposed for use downwell. Fibre optic sensors interrogate an optical fibre and analyse the backscattered radiation, either from deliberate point sensors within the fibre (e.g. Fibre Bragg gratings or the like) for from the intrinsic scattering sites within the fibre itself, to determine various parameters such as strain, vibration or temperature.

For example, fibre optic distributed acoustic sensing (DAS) is a known technique whereby a length of optical fibre is optically interrogated, usually by one or more input pulses, to provide sensing of acoustic activity along its length. Optical pulses are launched into the fibre and the radiation backscattered from within the fibre is detected and analysed. By analysing the radiation backscattered within the fibre, the fibre can effectively be divided into a plurality of discrete sensing portions which may be (but do not have to be) contiguous. Within each discrete sensing portion mechanical disturbances of the fibre, for instance, strains due to incident acoustic waves, cause a variation in the properties of the radiation which is backscattered from that portion. This variation can be detected and analysed and used to give a measure of the intensity of disturbance of the fibre at that sensing portion. Fibre optic distributed temperature sensing is also known and again relies on optically interrogating an optical fibre and analysing backscattered radiation. By analysing the backscattered radiation over time temperature changes at various parts of the optical fibre can be determined.

The use of fibre optic sensors downwell can be advantageous as the fibre optic cable can be made relatively rugged and thus can survive in a well environment and no power is needed downwell. The nature of the sensor means that data is readily acquired from different distances into the well.

WO2010/136773 teaches using such acoustic data to monitor various activities related to well formation and operation and suggests that DAS may be used for flow monitoring. This document teaches that the optical fibre to be used for sensing may be included in the well during the stages of well formation and that the optical fibre may be attached to the outside of an outer casing forced into the well bore which is subsequently cemented in place. This provides good acoustic coupling for the fibre and doesn't interfere with subsequent well operation. It also means that the fibre may be used for sensing during subsequent steps in well formation such a perforation.

However there are a significant number of existing wells in which no fibre is present.

In addition the use of optical fibre on the outside of the casing does typically mean that the optical fibre will be present when the perforation charges are fired. Typically, after the wellbore has been drilled, casing is inserted throughout substantially the whole of the working length/depth of the well and then cemented in place (for at least part of the well)—usually by forcing cement through the casing to the bottom and out to back fill the void between the casing and wellbore. This occurs before perforation. During perforation care should therefore be taken to orient the perforation charge away from the fibre to avoid severing the fibre when the charges are filed. The exact orientation of the perforation charges and position of the fibre are not generally known and so techniques such as magnetic anomaly detection may be used which add to the complexity and expense of well formation.

It would therefore be desirable to be able to monitor production flow at different depths within a well in use without the need for inserting any special instruments into the flow. It would also be desirable to be able to monitor flow in existing wells.

SUMMARY OF THE INVENTION

According to the present invention therefore there is provided a method of flow monitoring in a well comprising:

performing fibre optic sensing on an optical fibre deployed within the well, wherein the optical fibre is attached to first tubing that extends within the well to at least a first location at which it is wished to monitor inflow and wherein said tubing comprises at least one aperture having known properties at said first location.

The method of the present invention therefore uses fibre optic sensing on an optical fibre deployed within the well. The present invention can be implemented using any type of fibre optic sensor that can measure parameters that provide information about flow at a given location in a well however the invention is particularly applicable to distributed acoustic sensing and/or distributed temperature sensing.

As used in this specification the term "distributed fibre optic sensing" will be taken to mean sensing by optically interrogating an optical fibre to provide a plurality of discrete sensing portions distributed longitudinally along the fibre and the term "distributed fibre optic sensor" shall be interpreted accordingly. A distributed acoustic sensor shall be taken to mean such a sensor which detects acoustic signal incident on the fibre. The term "acoustic" shall be taken to mean any type of mechanical vibration or pressure wave, including seismic waves.

The optical fibre is attached to first tubing which extends within the well at least as far as the location where flow is desired to be measured. The first tubing provides (at least part of) the flow path between the well head and the first location. In a production well any product flowing to the surface must therefore flow through the first tubing.

The first tubing has at least one aperture having known properties. It will therefore be clear that the first tubing is separate to any outer casing which is cemented into place. Such casing is inserted without any apertures in the sidewalls and although apertures are formed in the casing when the perforation charges are fired the resulting apertures will clearly have unknown properties. The first tubing is therefore tubing which will be separate to, and inserted within, any such casing and used to provide for flow of any product.

Many wells do use inner tubing, often referred to as production tubing, within the outer casing to carry flow of product but only in an upper section of well. The production tubing is held in place by one or more packers which prevent flow of fluid other than through the production tubing. The production tubing does not however extend the full length of the well. Usually the production tubing is installed in a section of well which is some distance away from the location of the perforation sites.

For example, in some wells a borehole may be drilled to a certain depth, e.g. substantially vertically, which is where the reservoir of, e.g. oil/gas, is located. At the given depth the wellbore may then change direction and be drilled to maximise the length of the wellbore within the reservoir, e.g. substantially horizontally. All of the wellbore may be lined with a casing and the outside of the casing sealed with cement (so that no flow can occur outside of the casing) to prevent contamination of higher layers, aquifers etc. In such a well after perforation (which occurs in the section of wellbore which runs through the reservoir and which may be horizontal) the production tubing will be installed in a first section in the upper vertical part of the wellbore only. Structures such as packers are used to prevent access of the oil/gas to the first section other than via the production tubing. Thus flow in the first section can only occur within the production tubing. The production tubing will extend only for a short distance beyond the last packer and the rest of the wellbore will, in use fill with oil and gas.

The method of the present invention therefore may comprise deploying more tubing within the well than otherwise would conventionally be used. However the present inventors have realised that adding such additional tubing is relatively straightforward and can be readily applied to existing wells. For example guide tubing known as a stinger may be applied to existing tubing to aid in guiding/positioning a downwell tool. Tubing such as a stinger may therefore be coupled to production tubing and used as the first tubing in the present method, thus the first tubing may comprise a stinger. In other instances however the production tubing may be extended beyond the normal distance into the well.

As used herein the term flow tubing shall refer to tubing of a well which is present in the proximal part of the well (i.e. that part of the well nearest to the well head) and which carries fluid to or from a distal part of the well. Flow tubing may therefore comprise production tubing in a conventional production well. The first tubing used in embodiments of the present invention shall be arranged to be coupled to and be in fluid communication with flow tubing and may, in some instances, comprises a continuation of the same type of tubing that forms the flow tubing. Thus in a production well the flow tubing may comprise production tubing and the first tubing may comprise an extended section of production tubing. The first tubing and flow tubing are different to any outer wellbore casing which is cemented in place within the wellbore. The first tubing extends the flow path of the flow tubing to the first location where it is wished to monitor inflow. As the first tubing is coupled to and forms a flow path with the flow tubing, and may in some instance comprise the same type of tubing, the whole flow path from the well head to the first location at which it is wished to monitor inflow may be seen to comprise first tubing.

The flow through the at least one aperture in the first tubing will thus be indicative of the flow in the wellbore at that point. The method of the present invention thus ensures that an inlet (for a production well, or outlet for an injection well) to the main flow path of the well is located at the location where it is wished to monitor flow. The optical fibre attached to the tubing can then be interrogated to monitor the flow at this position, as will be described in more detail later.

The well may therefore comprises at least: a first section, in which fluid to be transported in the well in constrained to flow via flow tubing (e.g. production tubing) and is prevented from occupying the first section of wellbore outside of the flow tubing; and a second section wherein fluid to be transported via the well can be found within the first tubing and also outside of the first tubing. The first tubing may therefore extend into the second section, for instance to the location of at least one perforation site, and be in fluid communication with the flow tubing of the first section. The second section may comprise at least one non-vertical section.

However the deployment of the additional tubing is achieved it need only be done once and will then allow continual flow monitoring in use.

In some embodiments the first tubing extends into the well to a plurality of locations at which it is wished to monitor inflow and wherein the tubing has at least one aperture located at each of said locations. Thus for example, there may be a plurality of perforation sites from which it is wished to monitor flow and the first tubing may extend as far into the well as the furthest such perforation site. At each perforation site there will be at least one aperture to allow flow between the wellbore and the first tubing at that location. It will be appreciated that the flow into (or out of)

the first tubing at any given location will correspond to the flow into (or out of) the wellbore at that location.

The distal end of the first tubing in the well may be sealed so that the apertures are all arranged in a sidewall of the tubing. In some applications however the distal end of the tubing may comprise an aperture of known properties.

At this point it should be noted that that first tubing may comprise multiple different layers/materials and or may comprise more than one tube, e.g. at least one inner tube to provide a flow path and at least one outer tube to provide resilience. The tubing does not necessarily have to have any defined cross sectional shape, although a substantially circular cross section is likely to be most convenient in some wells.

Where there are multiple different tubes forming the first tubing the optical fibre may be attached to any of the tubes. The optical fibre may be attached to the inside of the tubing, i.e. within the flow path, or the outside of the tubing, on the outer surface or attached to an intermediate surface or embedded within the material of the walls of the tubing.

The optical fibre is conveniently attached to the first tubing so as to have a known orientation with respect to said at least one aperture. Having a known orientation with respect to the at least one aperture means that a potential variable in the response of the fibre optic sensor is eliminated. The response of the fibre optic sensing to a given flow condition can thus be predicted, for instance by collecting data using the same arrangement in a suitable trial using controlled flow conditions before the tubing is inserted in the well.

In some embodiments the first tubing may comprise a plurality of apertures of known properties at the first location. Having multiple apertures may in some instances provide an improved response and the effects of flow through multiple apertures can be detected. In other applications however providing a single aperture for flow may concentrate flow and prove a more detectable response. The skilled person, given the operating characteristic of a given existing or proposed well could readily decide on a preferred implementation and various apertures arrangements could be prepared and subjected to different flow rates in trials to determine a preferred arrangement.

In embodiments where there are a plurality of apertures at each location at least some of the apertures may have the same properties as one another so that such apertures can be expected to give the same response to given flow conditions. Additionally or alternatively at least some of the apertures may have different properties to one another. Looking at the overall response to flow through apertures of different known properties may help better determine the current flow characteristics. The aperture characteristics may comprise the aperture size and shape, i.e. aperture geometry.

In embodiments of the present invention at least one aperture is configured to provide a characteristic that varies with flow rate through the aperture. The characteristic that varies with flow rate may be an acoustic characteristic, such as acoustic intensity and/or acoustic frequency.

Thus in one embodiment one or more apertures may be arranged such that the acoustic intensity generated by flow through the aperture varies with flow rate. The acoustic intensity could thus be detected by using the optical fibre for distributed acoustic sensing and monitoring the acoustic intensity from the sensing portions. In effect the level of noise detected by distributed acoustic sensing from relevant sensing portion(s) of optical fibre could be analysed. The intensity from different sensing portions corresponding to the position of apertures at different locations of the wellbore could thus be compared to provide a relative indication of the flow at such sections. If the sensing portion next to an aperture at the first location detects a high intensity acoustic signal whereas a sensing portion next to an aperture at a second location detects a low intensity acoustic signal, this could indicate that there is greater flow at the first location than the second location. Given that both the properties of the aperture(s) and relative positioning of the fibre is known for each location the responses at the different locations can be calibrated for comparison for one another. In some embodiments the intensity may be analysed at one or more frequencies of interest, which may depend on the known properties of the aperture. The absolute value of intensity may be compared to known values, for instance recorded in a trial using similar apertures in similar tubing and a known flow rate, to give an actual estimate of flow rate.

The frequency of any detected acoustic signal may also be analysed. The aperture(s) may be arranged such that the frequency of the acoustic signal varies with flow rate. Thus looking at the frequency components of the detected signal it would be possible to estimate flow rate, or at least relative flow rate from different locations. For example at least one aperture may be configured to have resonance response at a given frequency and which may resonate strongly or not dependent on flow rate. Thus detecting a strong component at the relevant frequency (or possibly even just the presence of a strong tone) would indicate resonance and hence the flow rate. Where there are a plurality of apertures at each location one aperture may produce a relatively intense acoustic signal at a first frequency at a first flow rate whereas a different aperture may produce an intense response at a second different frequency at a second different flow rate.

It should be noted that the resonance frequency will depend on the speed of sound in the vicinity of the aperture which will in turn depend, at least partly, on the properties of the material. It may therefore be possible to monitor how a strong frequency changes over time to detect changes in material properties and/or compare the frequencies generated at different identical apertures located at different locations to determine the local speed of sound or material properties.

The characteristic that varies may additionally or alternatively be temperature. The aperture could be shaped to provide a defined temperature change that varies based on flow rate.

The method may therefore comprise performing distributed acoustic sensing (DAS) on said optical fibre. The method may comprise analysing the intensity and/or frequency of the acoustic signals detected in the vicinity of the at least one aperture. An indication of flow rate at said first location may be determined from the detected acoustic signals. As mentioned above this may be a relative flow rate as compared to other sections of the well and/or an indication of absolute flow rate value.

The method may additionally or alternatively comprise performing fibre optic distributed temperature sensing (DTS) on said optical fibre. As mentioned above the optical fibre may be arranged to detected temperature changes induced by flow through the apertures or may simply be arranged to provide an indication of the temperature of the fluid at a given location.

Where both distributed acoustic sensing and distributed temperature sensing are performed the same optical fibre may, in some instances, be used for both techniques. For instance a suitable optical fibre could be multiplexed between two suitable interrogators. In some embodiments however there may be at least two separate optical fibres attached to the first tubing, at least one for DAS and at least one for DTS.

It should be noted that as the aperture properties are known (and configured as desired) and the arrangement of the optical fibre in relation to the apertures is also controlled the main variables in the detected response (of the distributed fibre optic sensor) will be due to flow conditions. Thus the method of the present invention not only allows fibre optic based flow monitoring in wells that could not otherwise be monitored but it provides a means of detecting a response to standard conditions, i.e. monitoring using a standardized arrangement. Further these (monitoring) conditions will remain constant over time, i.e. the apertures will be made of hardwearing material and thus will maintain the same geometry and thus exhibit the same properties over time. For example the apertures may be formed from or lined with a ceramic material such as alumina. Such ceramics are high temperature and erosion resistant and can be easily fabricated via injection moulding techniques.

In the approach described in WO2010/136773 any acoustic noise from in-flow from perforation sites may be monitored by any fibre that was in the vicinity of the perforation sites. Whilst this can give an indication of flow, as mentioned above, there will be significant unknowns and variations. The exact position of the fibre relative to the perforation sites would be unknown. The control of perforation direction is not exact and in situations where the perforation fires through a casing (to which a fibre may be clamped) a magnetic anomaly detector may typically be used to help in orientation so that the charge doesn't sever the fibre when fired. Thus the exact direction of the perforations is typically not known and therefore the position of the optical fibre relative to the perforation is unknown and will typically vary at each perforation site. Also clearly the apertures in the casing will vary depending on the type of perforation charge, how effective it was and the properties of the casing and surrounding rock at the given perforation site. Thus the properties of the inflow apertures will be unknown. In wells that require hydraulic fracturing the fracturing process will also clearly affect the in-flow apertures in a totally unpredictable way. Also, perforations may change over time as flow occurs and erosion of the damaged material of the perforation site occurs.

Thus even in wells where optical fibre suitable for fibre optic sensing is present the method of the present invention provides better calibrated and more reliable data. Such data can be compared to suitable models and/or data which has been acquired under controlled conditions using the known aperture properties. The method of the present invention thus can provide a better estimate of relative flow or estimates of absolute flow rate value than previously known techniques.

The method of the present invention also does not rely on fibre which is in a fixed location on the outside of any outer casing which is present during the perforation step. Thus there is no need to ensure that the perforation charge is fired away from the optical fibre which eases the perforation step and also removes a potential restriction. Thus the perforation can be fired in any direction to achieve good production.

In some embodiments the optical fibre may be attached to the first tubing such that a first length of said first tubing, which includes the at least one aperture at the first location, comprises a section of optical fibre which is longer than said first length. As will be understood by one skilled in the art a distributed fibre optic sensor will provide measurement signals from discrete sensing portions of fibre. The minimum size of sensing portion, i.e. the best spatial resolution of the sensing portions, will depend on the interrogating radiation (and processing applied) and typically a shorter sensing portion length (i.e. better spatial resolution) will require shorter pulses (with reduced signal returns and lower sensitivity). The effective spatial resolution however will depend on the length of fibre which is deployed in use over a given distance. The method may therefore involve improving the spatial resolution achievable by ensuring that a given length of first tubing, say 1 m, has more than that length of optical fibre, i.e. more than 1 m. For instance consider that the optical fibre is used for distributed acoustic sensing and the minimum length of sensing portion it is wished to use (for sensitivity) is 5 m in length. Were 5 m of optical fibre to be provided in every 1 m length of tubing the effective spatial resolution would be 1 m.

The optical fibre may be attached to the first tubing such that the distributed fibre optic sensing has a greater spatial resolution in the vicinity of the at least one aperture than in the vicinity of a section of the tubing without an aperture. It may be that the increased spatial resolution is only required in the vicinity of the aperture(s).

The optical fibre may have a coiled arrangement, at least in the vicinity of said at least one aperture, i.e. the fibre may be arranged in a spiral or helical arrangement to provide an increased effective spatial resolution.

The invention also relates to an apparatus for flow monitoring. Thus in another aspect of the invention there is provided an apparatus for flow monitoring in wells comprising: first tubing configured to, in use, be coupled to flow tubing of a well wherein the first tubing has at least one aperture of known properties; and an optical fibre attached to said first tubing and configured such that said optical fibre can be used for distributed fibre optic sensing.

The apparatus according to this aspect of the invention can be used in all of the variants of the method described above and provides all of the same benefits. In particular the first tubing may comprise a stinger and/or the end of the first tubing which, in use, is not coupled to the flow tubing may be sealed.

The optical fibre may be configured to have a known orientation with respect to said at least one aperture. The first tubing may comprise a plurality of apertures of known properties at said first location. At least some of the plurality of apertures at the first location may have the same properties as one another and/or at least some of the apertures may have different properties to one another.

At least one aperture may be configured to provide a characteristic that varies with flow rate through the aperture. The characteristic that varies with flow rate may be at least one of acoustic intensity, acoustic frequency and temperature. At least one aperture may be configured to have a resonance frequency that varies with flow rate.

The first tubing may be deployed in a well coupled to flow tubing and the optical fibre may extend to the well head and be connected to a distributed fibre optic sensing interrogator unit. The distributed fibre optic sensing interrogator unit may comprise a distributed acoustic sensor interrogator unit and/or a distributed temperature sensor interrogator unit.

DESCRIPTION OF THE DRAWINGS

The invention will now be described by way of example only, with reference to the following drawings, of which.

DESCRIPTION OF THE INVENTION

Figure 1:
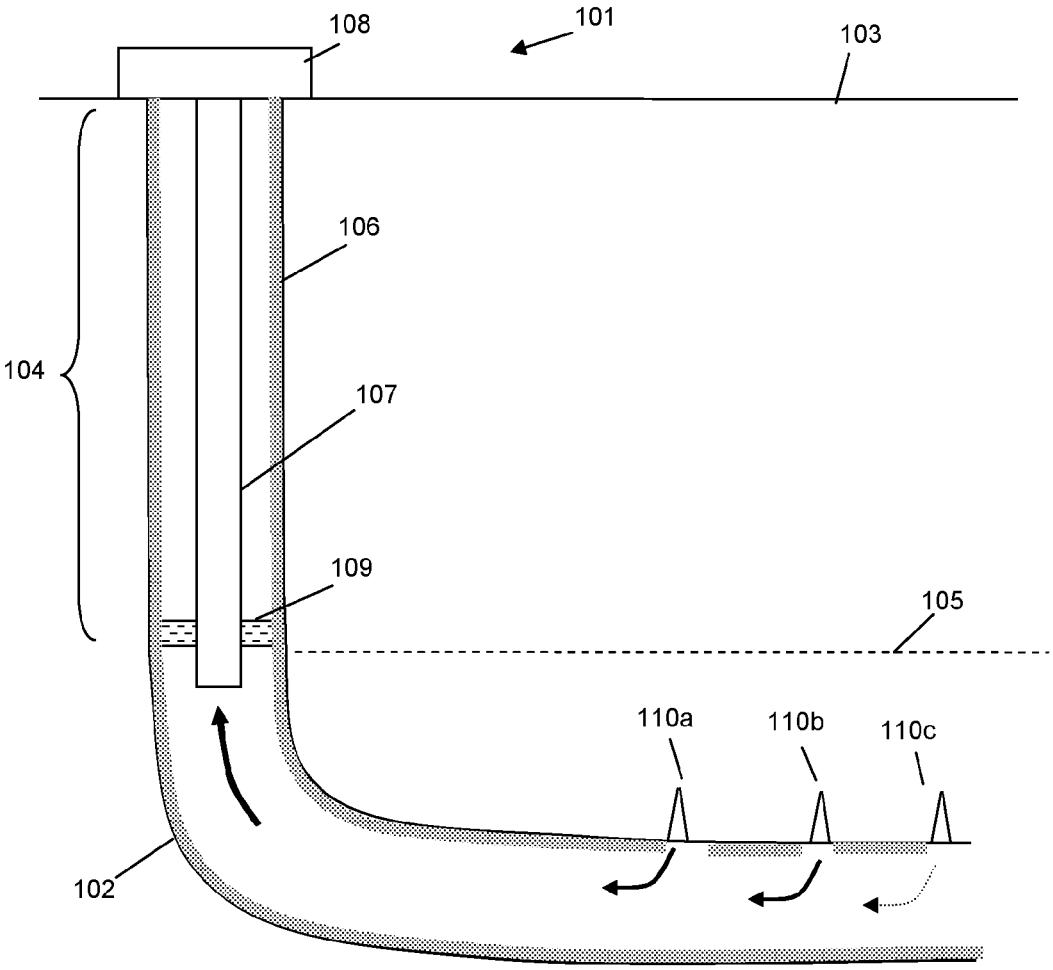
FIG. 1 illustrates one example of conventional well arrangement.

FIG. 1 illustrates one example of a conventional production well 101. The well comprises a wellbore 102 which is drilled in the ground 103. In this example the wellbore is drilled substantially vertically to desired depth where a hydrocarbon reservoir is located and then the wellbore is drilled substantially horizontally through the reservoir. However depending on location the well may be drilled at an angle away from vertical to reach the reservoir and then any suitable path that maximises the passage of the wellbore through the reservoir may be drilled.

The wellbore may pass through various rock layers which need to be protected from contamination during operation of the well. Thus a casing 106 may be inserted into the well bore to at least the required depth, typically the full distance into the well and any void between the casing and well bore filled with concrete (note numeral 106 shall be taken to represent a casing which is cemented in place. This ensure that when the well is subsequently perforated any oil or gas flow can initially only flow within the casing 106. After a perforation step, flow tubing—which in this example is production tubing 107—will be inserted into a first section 104 of well to carry product to the well head 108. The first section extends from the surface of the ground 103 to a desired depth 105. The depth 105 may be chosen as a depth at which it is desired to prevent contamination of aquifers layers etc. (the production tubing, being installed in the casing 106 providing additional leak protection). However the first section of well may be the minimum depth required to achieve good flow. In any case the production tubing does not extend the full distance of the well.

The production tubing may be held in place by one or more packers 109 and the packer furthest into the well acts as a barrier preventing any flow of oil or gas into the first section of well 104 other than through the production tubing 107.

The skilled person will of course appreciate that there may be various other casing and other apparatus such as pumps etc. in practice. However it will be understood that in the first section of well flow is purely through the production tubing 107. The production tubing extends for a short distance beyond the last packer 109 into the second section of well (i.e. that part of the well below depth 105).

The second section of well, which in this example includes the horizontal section of well, is where the perforation sites 110*a-c* are located (only three are shown in FIG. 1 but the skilled person will appreciate that there may be many more in practice). As mentioned above by drilling substantially horizontally the passage of the wellbore through the reservoir can be maximised. Thus there may be several different perforation sites 110 located along the length of the well section.

In such a conventional well, flow will occur from the perforation sites and the product will flow within the wellbore 102, filling the whole of the casing 106, to the first section, where it will flow through the production tubing 107 only to reach the wellhead 108. The flow at the well head can be monitored but clearly this represents the combined flow from all perforation sites. It is therefore not possible to determine the relative flow from the various different perforation sites. As illustrated in FIG. 1 this may not be even and the flow from the perforation site 110*c* may be much lower than the flow from sites 110*a* and 110*b*. This information may be useful as it may indicate that such a section of the reservoir provides a lower yield—which may be useful for planning additional wells.

If any optical fibre (not shown) had been included within the well when it was formed, such as taught in WO2010/136773, such fibre may be on the outside of casing 106 in the second section. Whilst this fibre could be used to provide flow monitoring embodiments of the present invention provide much more reliable and accurate flow monitoring.

Figure 2:
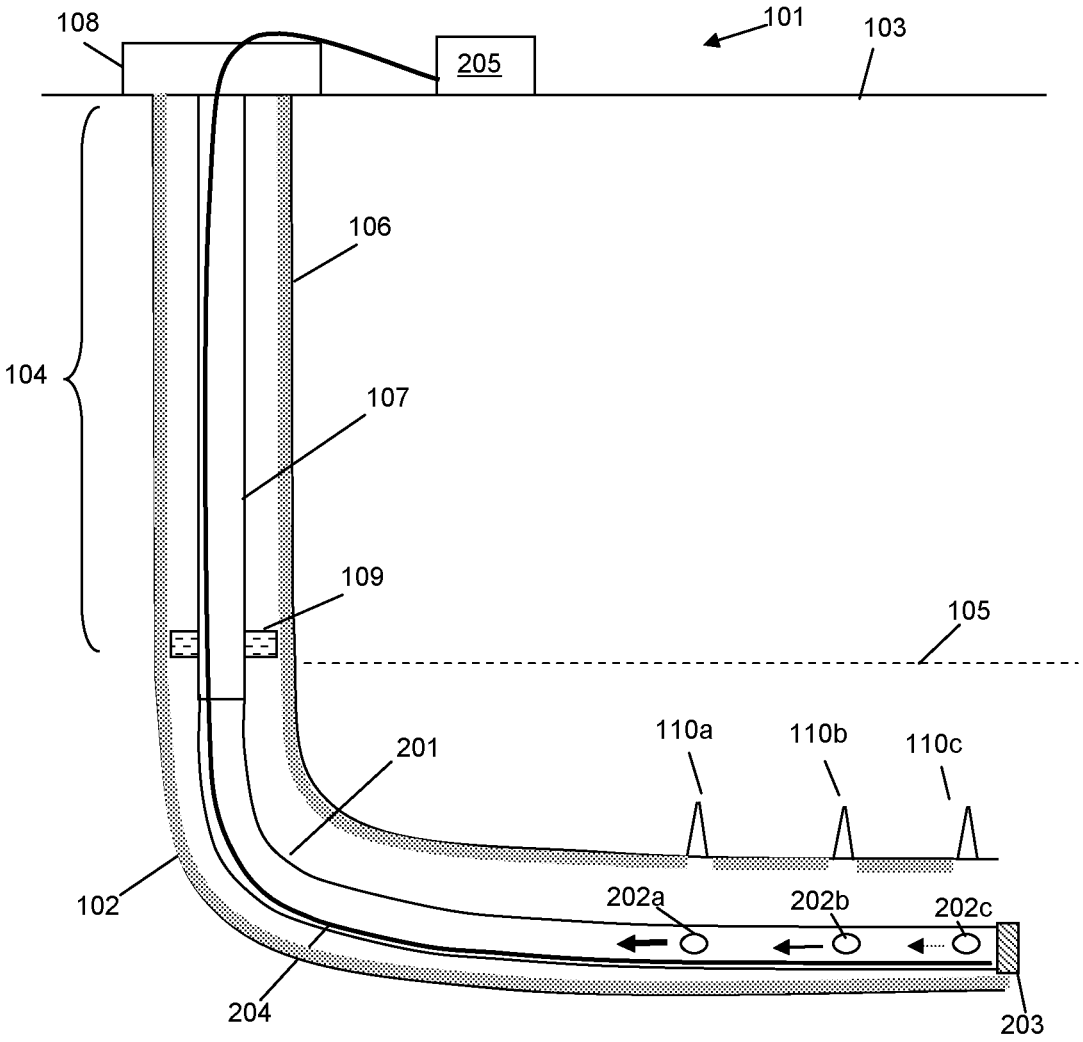
FIG. 2 illustrates a well arrangement according to embodiment of the present invention.

FIG. 2 illustrates an embodiment of the present invention. FIG. 2 shows the same well arrangement as FIG. 1, and thus the same components are identified using the same numerals, but in the well shown in FIG. 2 additional tubing 201 has been included which is coupled to the bottom of the production tubing 107 and which extends into the well at least as far as perforation site 110*c*.

The additional tubing could comprise an extension of the production tubing 107 and be fitted at the same time as the production tubing. For existing wells this may involve removing the existing production tubing and reinstalling the production tubing with the extension. However in some wells it may be possible to add the existing tubing by feeding it through the existing production tubing. A tool called a stinger is sometimes used in this way to provide a guide for other downwell tools. A suitable stinger could therefore be used at the tubing 201. Any tubing that can be coupled to the production tubing 107 to provide an addition to the flow path may be used. Using a stinger also allows for depth calibration as the location of the stinger downwell is known fairly accurately.

As mentioned the additional tubing extends to at least perforation site 110*c*. In the vicinity of each perforation site 110*a*, 110*b*, and 110*c* there is at least one respective aperture 202*a*, 202*b*, 202*c* to provide an inlet for flow of product into the tubing 201. As will be described later the apertures have known properties. Flow from the perforation sites into the wellbore 102 will thus only find an outlet via the tubing 201 which is coupled to the production tubing 107. Thus the product will flow into the tubing 201 via the apertures 202*a-c* and, as the skilled person will appreciate, the flow via any given aperture will depend on the pressure within the wellbore at that point which will be governed by the flow from the perforation sites. Thus the flow though any given aperture is related to the general flow at that part of the well.

In this example the end of the tubing 201 is sealed with an appropriate cap 203. However in other embodiments the end of the tubing could itself be shaped to form an inlet of desired properties. Thus in this embodiment the only flow path from the second section of well to the well head is via the apertures 202*a-c* and the tubing 201.

Attached to the tubing 201 is at least one optical fibre 204. The optical fibre extends at least as far as perforation site 110*c* and runs along the length of the tubing 201. It further passes through the first section 104 of well and emerges through the well head 108 where it is connected to an interrogator unit 205, which may be a distributed acoustic sensing interrogator unit.

The optical fibre may be attached to the tubing 201 in any convenient way. The fibre may be attached to the inside of tubing 201 and thus may run within tubing 201 and also within production tubing 107. If the tubing 201 is additional tubing inserted with existing production tubing in situ then the fibre optic cable may be firmly attached to the additional tubing but may run relatively freely through the production tubing. If however the production tubing is installed with the additional tubing attached then optical fibre may be attached to the production tubing in any desired way (or some other structure inserted with the production tubing) and run inside or outside the production tubing. Clearly the fibre should be arranged so that it doesn't interfere with any seal formed in the tubing nor interfere with any apparatus within the first section 104 such as a pump.

In use therefore the optical fibre can be interrogated to provide fibre optic sensing in the vicinity of each of the perforation sites 110*a-c*. The present inventors have realised that it is relatively straightforward to add additional tubing to the end of production tubing in existing wells and this allows three particular advantages:

1) the additional tubing can extend to the perforation sites and thus provides vehicle for getting the sensing fibre to the desired location;

2) the tubing can be arranged to provide the only flow path to the top of the well such that flow into the tubing at a given point is indicative of the flow from the perforation site at that location;

3) the arrangement of the optical fibre with respect to the apertures in the tubing 201 can be controlled, as can the properties of the apertures themselves, thus ensuring a calibrated response.

As the properties of the apertures, and relative positioning of the fibre to the apertures, is known and controlled this means that various models can be applied to the range of response expected and it is possible to conduct trials in a laboratory setting using the same tubing, aperture and fibre arrangement and applying different flow conditions. Thus the embodiments of the present invention not only provide the ability to conduct flow sensing during normal operation in wells where such was not previously possible, but even in wells where optical fibre may be present in the vicinity of perforation sites the embodiments of the present invention will provide a much more calibrated response as uncertainties in in-flow aperture size, geometry and location are eliminated. The apertures in the tubing can be formed in hardwearing materials, such as ceramics, and thus the properties will remain substantially constant over time.

The properties of the apertures may be chosen to provide a relatively strong response for the particular fibre optic sensor implemented on the optical fibre. For instance when the optical fibre is to be interrogated to provide distributed acoustic sensing the apertures are designed to lead to a desired acoustic response.

The response could simply be intensity. Thus the greater the flow the more noise that is detected. Hence determining the intensity of the acoustic response from the sensing portion of fibre at the aperture can be used to monitor flow. If the same fibre arrangement and aperture properties are used for each aperture 202*a*, 202*b* and 202*c* the acoustic response from each section can be directly compared to determine relative flow. In addition, as mentioned above as the exact arrange of optical fibre and apertures is known the absolute intensity may be used to estimate the absolute flow rate at the location where the aperture is.

The aperture may also be arranged to lead to other characteristics that vary with flow rate. For instance the apertures could be arranged to generate an acoustic signal where the frequency component is related to flow rate. Thus apertures could be arranged so that a first flow rate generates an acoustic response which is intense at a first frequency and a different flow rate leads to an acoustic response with a different frequency spread. The acoustic signals detected in use can therefore be analysed in frequency to determine the spectrum, or the relative intensity at one or more frequencies of interest, and thus determine the relative flow through each aperture.

One aperture could therefore be arranged to have a resonance frequency which is flow rate dependent (e.g. whether resonance occurs or not) and/or there may be multiple apertures at each perforation site at least some apertures may produce acoustic signals at defined frequencies when certain flow rates are experienced and at least some of the apertures may be tuned to different frequencies at different flow rates to one another. Thus at a first flow rate one aperture may produce an intense signal at a first frequency whereas a second aperture may produce a relatively low intensity response. At a different flow rate the second aperture may produce a strong response at a second frequency whereas the response of the first aperture may be less intense.

In addition, as the position of the optical fibre relative to the apertures is controlled by arranging the fibre on the surface before insertion into the well any particular arrangement may be used and the fibre may be attached to tubing 201 so as to have a better sensitivity and/or spatial resolution than would be the case for a rectilinear arrangement.

As the skilled person will appreciate in a distributed fibre optic sensor there is typically a trade off between sensitivity and minimum size of the sensing portions of the fibre sensor, i.e. the native spatial resolution of the sensor. However the effective spatial resolution is determined by the amount of fibre deployed in a given area.

Figure 3:
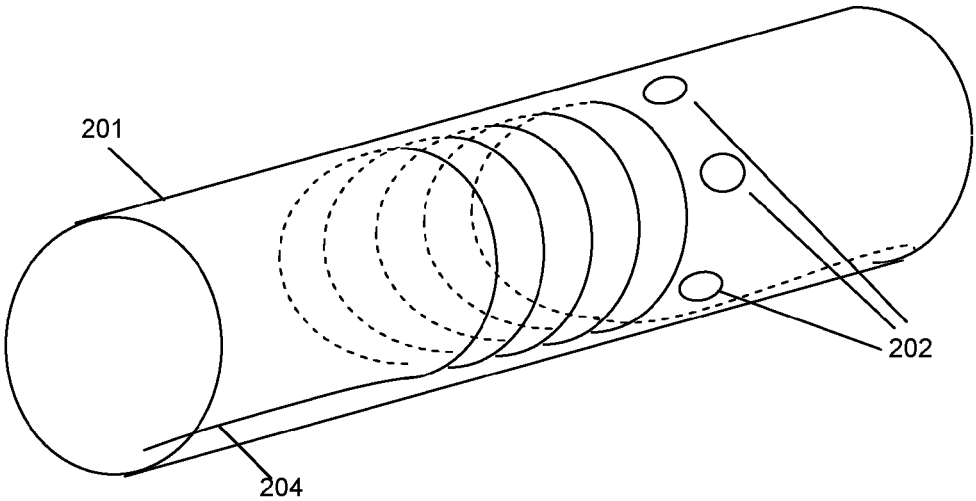
FIG. 3 illustrates a section of tubing that can be used for flow monitoring according to an embodiment of the present invention.

FIG. 3 shows one embodiment showing a section of tubing 201 with a plurality of apertures 202 at a given location. For instance the apertures may be evenly spaced circumferentially around the tubing to provide evenly inlets all around the tubing. The optical fibre 204 is wound, in this example, into a helical arrangement in the vicinity of the apertures 202 although other arrangements are clearly possible. The pitch of the helix and number of turns can be chosen according to the desired properties. For instance if the native spatial resolution of the distributed fibre optic sensor is say 10 m, i.e. this is the normal length of the sensing portion, but a spatial resolution of 1 m is preferred, the helix could be arranged to ensure there is 10 m of fibre in a 1 m section of tubing.

Depending on the application the fibre could be arranged to provide the same spatial resolution along the length of tubing 201 but in other applications, as shown in FIG. 3, the fibre may be arranged to vary the spatial resolution along the tubing and thus may provide an increased spatial resolution in certain areas, such as near the apertures.

Figure 4:
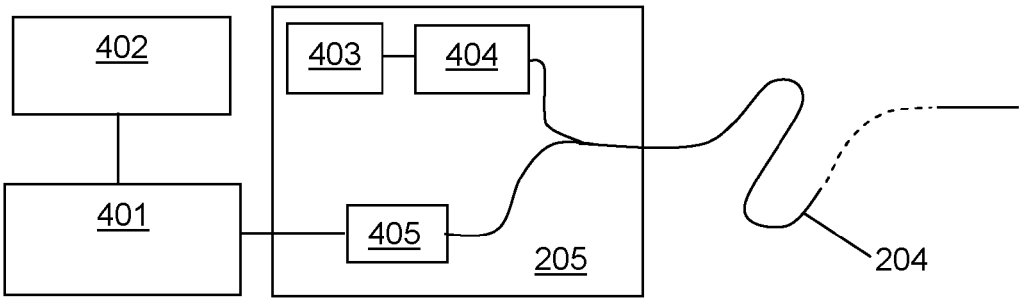
FIG. 4 illustrates a conventional distributed fibre optic sensor arrangement.

As mentioned above the method may be particularly implemented using distributed acoustic sensing. FIG. 4 shows the basic components of a conventional distributed acoustic sensing (DAS) arrangement. As mentioned the optical fibre 204 is connected at the top side of the well to an interrogator 205. The output from interrogator 205 may be passed to a signal processor 401, which may be co-located with the interrogator or may be remote therefrom, and optionally a user interface/graphical display 402, which in practice may be realised by an appropriately specified PC. The user interface may be co-located with the signal processor or may be remote therefrom.

The sensing fibre 204 can be many kilometres in length and can be, for instance 40 km or more in length if required. Typically well depths may be significantly less than this but, as mentioned, the fibre may be wound to use more fibre than the length of the well. The sensing fibre may be a standard, unmodified single mode optic fibre such as is routinely used in telecommunications applications without the need for deliberately introduced reflection sites such a fibre Bragg grating or the like (although some embodiments may use integrated point sensors in the fibre). The ability to use an unmodified length of standard optical fibre to provide sensing means that low cost readily available fibre may be used. However in some embodiments the fibre may comprise a fibre which has been fabricated to be especially sensitive to incident vibrations. The fibre will be protected by containing it with a cable structure. In use the fibre 204 is deployed as described above.

In operation the interrogator 205 launches interrogating electromagnetic radiation, which may for example comprise a series of optical pulses having a selected frequency pattern, into the sensing fibre. The optical pulses may have a frequency pattern as described in GB patent publication GB2,442,745 the contents of which are hereby incorporated by reference thereto, although DAS sensors relying on a single interrogating pulse are also known and may be used. Note that as used herein the term "optical" is not restricted to the visible spectrum and optical radiation includes infrared radiation and ultraviolet radiation. As described in GB2,442,745 the phenomenon of Rayleigh backscattering results in some fraction of the light input into the fibre being reflected back to the interrogator, where it is detected to provide an output signal which is representative of acoustic disturbances in the vicinity of the fibre. The interrogator therefore conveniently comprises at least one laser 403 and at least one optical modulator 404 for producing a plurality of optical pulses separated by a known optical frequency difference. The interrogator also comprises at least one photodetector 405 arranged to detect radiation which is Rayleigh backscattered from the intrinsic scattering sites within the fibre 204. A Rayleigh backscatter DAS sensor is very useful in embodiments of the present invention but systems based on Brillouin or Raman scattering are also known and could be used in embodiments of the invention.

The signal from the photodetector is processed by signal processor 401. The signal processor conveniently demodulates the returned signal based on the frequency difference between the optical pulses, for example as described in GB2,442,745. The signal processor may also apply a phase unwrap algorithm as described in GB2,442,745. The phase of the backscattered light from various sections of the optical fibre can therefore be monitored. Any changes in the effective optical path length within a given section of fibre, such as would be due to incident pressure waves causing strain on the fibre, can therefore be detected.

The form of the optical input and the method of detection allow a single continuous fibre to be spatially resolved into discrete longitudinal sensing portions. That is, the acoustic signal sensed at one sensing portion can be provided substantially independently of the sensed signal at an adjacent portion. Such a sensor may be seen as a fully distributed or intrinsic sensor, as it uses the intrinsic scattering processed inherent in an optical fibre and thus distributes the sensing function throughout the whole of the optical fibre.

Some embodiments may additionally or alternatively use distributed temperature sensing (DTS) which the skilled person will be familiar with.

The invention claimed is:

1. A method of flow monitoring in a well comprising:

performing fibre optic sensing on an optical fibre deployed within the well, wherein the optical fibre is attached to first tubing that extends within the well to at least a first location at which it is wished to monitor inflow and wherein said tubing comprises a plurality of apertures each having a known size and shape at said first location, the size and shape of each aperture being configured to provide a characteristic that varies with flow rate through an aperture, and the apparatus being configured such that the characteristics are different between at least some of the plurality of apertures at the first location, and monitoring flow conditions using fibre optic distributed sensing of the characteristics of each of the apertures.

2. The method as claimed in claim 1 wherein the optical fibre is configured to have a known orientation with respect to said at least one aperture.

3. The method as claimed in claim 1 wherein the characteristic that varies with flow rate is at least one of acoustic intensity, acoustic frequency and temperature.

4. The method as claimed in claim 1 wherein at least one aperture is configured to have a resonance frequency that varies with flow rate.

5. The method as claimed in claim 1 wherein the first tubing extends into the well to a plurality of locations at which it is wished to monitor inflow and wherein the tubing has at least one aperture located at each of said locations.

6. The method as claimed in claim 1 wherein the optical fibre is attached to the first tubing such that a first length of said first tubing comprising said plurality of apertures at the first location comprises a section of optical fibre which is longer than said first length.

7. The method as claimed in claim 6 wherein the optical fibre is attached to the first tubing such that distributed fibre optic sensing performed on the optical fibre has a greater spatial resolution in the vicinity of the at least one aperture than in the vicinity of a section of the tubing without an aperture.

8. The method as claimed in claim 1 wherein the optical fibre has a coiled arrangement at least in the vicinity of said at least one aperture.

9. The method as claimed in claim 1 wherein the well comprises at least:

a first section, in which fluid to be transported in the well is constrained to flow via flow tubing and is prevented from occupying the first section of wellbore outside of the flow tubing; and a second section wherein fluid to be transported via the well can occupy the first tubing and an area outside of the first tubing;

wherein the first tubing extends into the second section and is in fluid communication with the flow tubing of the first section.

10. The method as claimed in claim 9 wherein the second section comprises at least one non-vertical section.

11. The method as claimed in claim 1 wherein said method comprises performing distributed acoustic sensing on said optical fibre.

12. The method as claimed in claim 11 comprising analysing the intensity and/or frequency of the acoustic signals detected in the vicinity of the at least one aperture.

13. The method as claimed in claim 11 comprising determining an indication of flow rate at said first location from the detected acoustic signals.

14. The method as claimed in claim 1 comprising performing distributed temperature sensing on said optical fibre.

15. An apparatus for flow monitoring in wells comprising:

first tubing configured to, in use, be coupled to flow tubing of a well, wherein the first tubing has apertures each having a known size and shape, the size and shape of each aperture being configured to provide a characteristic that varies with flow rate through an aperture, and the apertures being configured such that the characteristics are different between at least some of the apertures; and an optical fibre attached to said first tubing and configured such that said optical fibre can be used for fibre optic sensing of the characteristics of each of the apertures.

16. The apparatus as claimed in claim 15 wherein the first tubing comprises a stinger.

17. The apparatus as claimed in claim 15 wherein the end of the first tubing which is not coupled to the flow tubing in use, is sealed.

18. The apparatus as claimed in claim 15 wherein the optical fibre is configured to have a known orientation with respect to said at least one aperture.

19. The apparatus as claimed in claim 15 wherein the first tubing is deployed in a well coupled to flow tubing and the optical fibre extends to the well head and is connected to a distributed fibre optic sensing interrogator unit.

* * * * *